US005228564A

United States Patent [19]

Randeria

[11] Patent Number: 5,228,564

[45] Date of Patent: Jul. 20, 1993

[54] PACKAGE FOR DISPLAYING A PLURALITY OF DIFFERENT SIZED CONTAINERS

[75] Inventor: Dilip V. Randeria, Yorba Linda, Calif.

[73] Assignee: Hunt-Wesson, Inc., Fullerton, Calif.

[21] Appl. No.: 867,897

[22] Filed: Apr. 13, 1992

[51] Int. Cl.[5] ..... B65D 5/50

[52] U.S. Cl. ..... 206/45.14; 206/45.33; 206/432; 206/497

[58] Field of Search ..... 206/427, 431, 432, 433, 206/497, 45.14, 45.19, 45.33, 193–196

[56] References Cited

U.S. PATENT DOCUMENTS

| | | | |
|---|---|---|---|
| 2,358,523 | 9/1944 | McKinley | 206/194 |
| 2,959,276 | 11/1960 | Srofe | 206/45.14 |
| 2,986,271 | 5/1961 | Forrer | 206/427 |
| 3,003,620 | 10/1961 | Srofe | 206/45.14 |
| 3,424,301 | 1/1969 | Forrer et al. | 206/431 |
| 3,503,492 | 3/1970 | Marsh . | |
| 3,693,788 | 9/1972 | Oglesbee . | |
| 3,991,880 | 11/1976 | Austrins et al. | 206/431 |
| 4,324,328 | 4/1982 | Champlin | 206/194 |
| 4,643,307 | 2/1987 | Wilkinson . | |
| 4,687,128 | 8/1987 | White . | |
| 4,736,846 | 4/1988 | Durand . | |
| 4,919,266 | 4/1990 | McIntosh . | |

*Primary Examiner*—Bryon P. Gehman
*Attorney, Agent, or Firm*—Pretty, Schroeder, Brueggemann & Clark

[57] ABSTRACT

Display packaging accepts different-sized, preferably generally cylindrical containers and holds them in fixed relative positions such that they are arranged along a common frontal plane and their labels can be read. The display packaging includes a sheet material that is folded to have a base section upon which the containers rest, a vertically-extending section, and a yoke section that projects forward from the vertically-extending section and includes a recess that fits around the top end of one container to properly position it so as to align with the other containers along a common frontal plane. A transparent film is wrapped around the sheet material and the containers to hold the containers in position.

10 Claims, 2 Drawing Sheets

PACKAGE FOR DISPLAYING A PLURALITY OF DIFFERENT SIZED CONTAINERS

BACKGROUND OF THE INVENTION

1. Field of the Invention

This invention relates to display packaging and, more particularly, to display packaging for holding a plurality of different-sized containers upright in fixed position along a common frontal plane.

2. Description of the Related Art

A variety of display packaging designs have been used to arrange generally cylindrical containers, such as drinking glasses, bottles, or cans, in fixed relative positions for display and sale in retail outlets. The containers are held together such that they can be displayed as a unit and the individual containers can be viewed. Typically, such display packaging holds the containers so as to provide the greatest space efficiency so that the packaged containers occupy the least volume. Frequently, the containers are partially obscured or the display packaging units are difficult to stack or arrange in retail displays. As a result, the display packaging is not especially attractive to consumers. This reduces the marketability of the containers.

Typical display packaging designs are especially likely to be inefficient and unattractive when the containers are not of identical size and shape. For example, prepared foods may be packaged in separate containers that are combined to comprise one meal. When different-sized containers are packaged together, they must be held securely so they can be displayed as a unit and do not become separated. For the retail environment, it also is important that any labels on the containers are readily viewable so the consumer can make an informed purchase and can be persuaded by the labelling of the container itself Containers are sometimes wrapped together with shrink-wrapping or a similar transparent film. Such display packaging allows the container labels to be read, but makes it difficult for the packaged units to be stacked or otherwise efficiently arranged into attractive displays. In addition, it can be difficult to hold the cylindrical containers in fixed relative positions while the shrink wrapping is being applied, making the packaging process more difficult and costly.

From the foregoing discussion, it should be apparent that there is a need for display packaging that can hold different-sized containers in fixed relative positions for attractive display at a reasonable cost. The present invention meets this need.

SUMMARY OF THE INVENTION

The present invention provides display packaging that securely holds a plurality of containers of differing sizes in an upright orientation along a common front plane, forming an arrangement of the containers that allows the container labels to be easily read and that allows the containers to be conveniently displayed. In accordance with the invention, a sheet material is used to orient the containers in their desired respective positions. A portion of the sheet material has a cut-out portion and is bent forward to form a yoke portion that holds one of the containers in a position in which its front edge is aligned with the front edge of the other, different-sized containers. The sheet material, for example, can comprise a relatively low cost corrugated cardboard. Finally, a transparent film is wrapped around the sheet material and containers, securely holding the sheet material and the containers together. Such display packaging can hold different-sized containers in fixed relative positions for attractive retail display and can be produced at a relatively low cost.

In one aspect of the invention, the sheet material includes a plurality of fold lines that define a base section, a vertical section, and a yoke section, the base section having a forward edge that is opposite the base section fold line and that defines a common front plane for the containers such that the containers can be placed on the base section with their bottom ends aligned along the forward edge. The base section includes means for maintaining the smaller dimensioned containers spaced forward on the base section to the forward edge. This can be achieved, for example, by a folding tab that is located at the rear of the base section and is bent upward. The yoke section includes a cut-out recess that fits around the top end of one container, helping to maintain the position of the container on the base section.

The transparent film that is tightly wrapped around the sheet material and the containers is preferably formed from a plastic wrap, such as polypropylene. Any transparent material that is somewhat flexible and that can be stretched around the sheet material and the containers can be used, if the material can be bound securely to provide a secure seal and hold the containers and sheet material as a unit. If desired, the display package units advantageously can be placed in open boxes and separated by dividing walls.

Other features and advantages of the present invention should be apparent from the following description of the preferred embodiment, taken in conjunction with the accompanying drawings, which illustrate, by way of example, the principles of the invention.

DESCRIPTION OF THE PREFERRED EMBODIMENT

Figure 1:
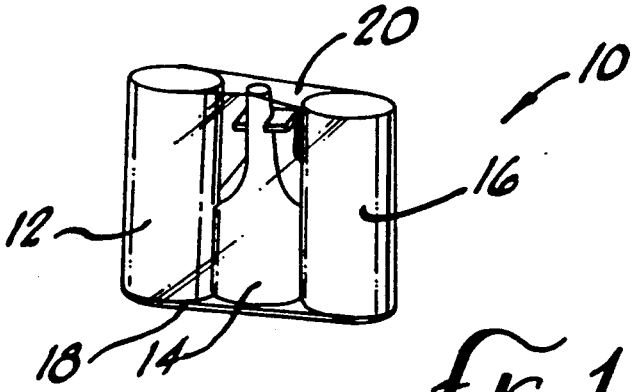
FIG. 1 is a perspective view of display packaging in accordance with the present invention, showing three generally cylindrical containers.

Referring to the drawings, and in particular to FIG. 1, there is illustrated display packaging 10 comprising three generally cylindrical containers 12, 14, and 16 that are placed on a sheet material 18, all of which are wrapped within a transparent film 20 that securely holds the containers in their relative positions on the sheet material so that the containers are aligned along a common front plane. The transparent film 20 can comprise a polypropylene film. The middle container 14 comprises a bottle with a neck that has a smaller diameter than its bottom, but it is to be understood that other combinations of sizes and containers also can be used in accordance with the present invention. Such display packaging can hold different-sized containers in fixed relative positions along a common front plane for attractive retail display and can be produced at a relatively low cost.

Figure 2:
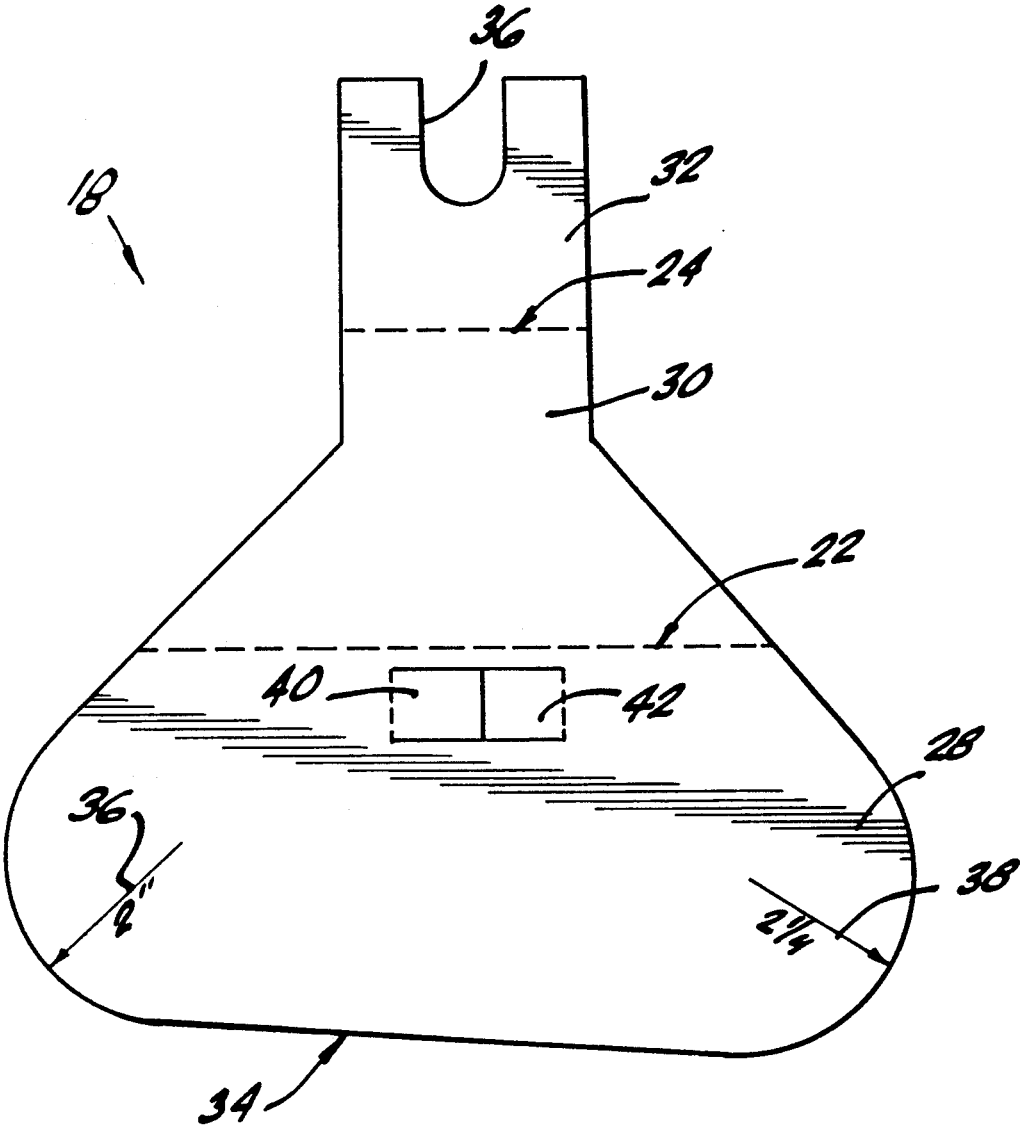
FIG. 2 is a plan view of the sheet material, illustrated in FIG. 1, before it is folded.

FIG. 2 illustrates the sheet material 18 before it has been folded into an orientation such that the containers 12, 14, and 16 can be positioned as shown in FIG. 1. The sheet material can comprise, for example, relatively low-cost, strong corrugated cardboard. The sheet material includes two fold lines 22 and 24 that define a base section 28, a vertical section 30, and a yoke section 32. The fold lines can comprise, for example, perforations in the corrugated cardboard sheet material. The base section 28 has a straight, forward edge 34 opposite the base section fold line 22 that defines the common front plane along which the containers can be aligned upright, with the bottom ends of the containers resting on the base section 28. The base section has two curved portions, the first having a radius indicated by the arrow 36 and the second having a radius indicated by the arrow 38. The first radius is a different size from the second radius, but it is to be understood that both radii alternatively can be the same size to accommodate containers 12 and 16 that are the same size.

Figure 3:
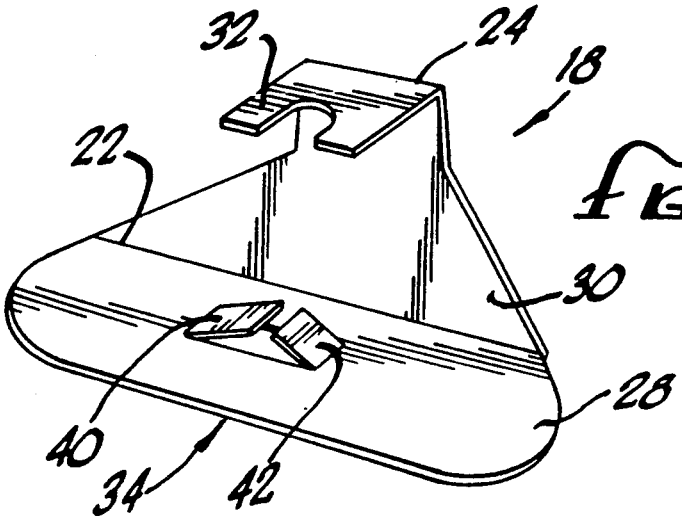
FIG. 3 is a perspective view of the sheet material illustrated in FIG. 1, before any containers have been placed on its base section.

The sheet material 18 can be folded along the fold lines 22 and 24 to properly position the containers 12, 14, and 16 (FIG. 1) on the base section 28, as shown in FIG. 3. When the sheet material is bent upwardly along the base/vertical section fold line 22 and is bent forwardly along the vertical/yoke section fold line 24, the yoke section 32 is lifted upwardly, above the base section. The yoke section includes a cut-out recess 36 that fits around the top end of the smallest cylindrical container 14 when the yoke section is lifted upwardly. The recess helps hold the container 14 in its proper position on the base section 28 so that the container, which has a smaller diameter than the other containers 12 and 16, is aligned along the front plane defined by the forward edge 34 of the base section.

FIGS. 2 and 3 show that the base section 28 also includes a pair of tabs 40 and 42 that hold the containers in their desired relative positions on the base section. The tabs can be pushed upwardly so as to extend above the base section and hold the smallest diameter container 14 forward on the base section so the container is aligned along the front plane defined by the forward edge 34 of the base section. Those skilled in the art will appreciate that the size of the tabs can be adjusted to accommodate containers 14 of different sizes. Alternatively, if the middle container has the largest diameter and the two outer containers 12 and 16 have the smaller diameters, then the tabs would be located on the base section such that the outer containers are held forward on the base section to be aligned along the front plane. In either case, the base section tabs are formed by perforations in the sheet material 18 and are easily pushed upwardly to help properly position the containers 12, 14, and 16 on the base section 18.

Figure 4:
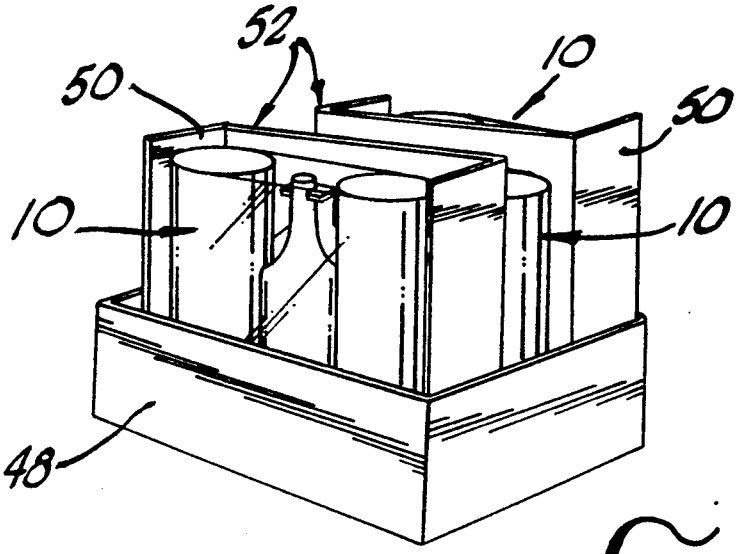
FIG. 4 is a perspective view of several packaging units in accordance with the present invention arranged in a shipping carton.

FIG. 4 illustrates an arrangement of several display packaging units 10 in accordance with the invention. The units are arranged in a shipping carton 48 whose top has been cut away for display purposes. Alternatively, the units may be placed directly into a tray. The units are separated within the carton by dividing walls 50 comprising sheet material, such as corrugated cardboard, that is folded into the shape of a "C" and placed upright on end, so that the dividing wall extends along the back of the display packaging units and along the sides of the containers 12 and 16. Preferably, the top edge 52 of the dividing walls extends above the top of the containers 12, 14, and 16 to make it easier to stack cut-away cartons 48 filled with the display packaging units 10.

From the foregoing, it will be appreciated that the packaging arrangement in accordance with the invention can hold different-sized containers in fixed relative positions for attractive retail display and can be produced at a relatively low cost.

The present invention has been described above in terms of a presently preferred embodiment so that an understanding of the present invention can be conveyed. There are, however, many configurations for packaging arrangements not specifically described herein, but with which the present invention is applicable. The present invention should therefore not be seen as limited to the particular embodiments described herein, but rather, it should be understood that the present invention has applicability with respect to packaging arrangements in a variety of applications. All modifications, variations, or equivalent arrangements that are within the scope of the attached claims should therefore be considered to be within the scope of the invention.

I claim:

1. Display packaging for holding a plurality of different sized containers in an upright orientation along a common front vertical plane, the display packaging comprising:

a sheet material having a horizontal base section, a vertical section made of a single layer of the sheet material, and a yoke section, the sheet material also having a first fold line between the horizontal base section and the vertical section, and a second fold line between the vertical section and the yoke section, the second fold line permitting the yoke section to be disposed in a spaced apart relationship over the horizontal base section;

the horizontal base section having a straight, forward edge opposite the first fold line that defines the common front vertical plane such that the plurality of different sized containers can be aligned upright along the forward edge, with the bottom ends of the plurality of different sized containers on the base section;

the yoke section including means for spacing one of the plurality of different sized containers forward away from the first fold line;

said sheet material being folded to hold the plurality of different sized containers such that the common front vertical plane is unobstructed between the straight forward edge of the horizontal base section and the yoke section; and a transparent film that is wrapped around the sheet material and the plurality of different sized containers, the transparent film holding the plurality of different sized containers securely to the sheet material in their aligned position.

2. Display packaging as defined in claim 1, wherein the sheet material comprises corrugated cardboard and the fold lines comprise perforations in the cardboard.

3. Display packaging as defined in claim 1, wherein the means for spacing comprises a cut-out recess in the yoke section that fits around the top end of said one of the plurality of different sized containers.

4. Display packaging as defined in claim 1, wherein the base section further includes tabs that are folded upwardly to also hold said one of the plurality of different sized containers forwardly spaced on the horizontal base section.

5. Display packaging holding a plurality of generally cylindrical containers of at least two different diameters in an upright orientation along an unobstructed common front vertical plane, the display packaging comprising:

a flat horizontal base section having a free forward edge that defines the common font vertical plane such that the plurality of generally cylindrical containers can be aligned upright along the forward edge, with the bottom ends of the plurality of generally cylindrical containers placed on the base section, and having a straight rear edge that defines a back plane;

a flat vertical section, having a straight lower edge and a straight upper edge, that is attached at its lower edge to the base section along the rear edge;

a yoke section, having a straight rear edge and a free font edge adapted to bear against the top end of one of the plurality of generally cylindrical containers, that is attached at its rear edge to the vertical section along the upper edge;

the base section, vertical section and yoke section being arranged such that the common front vertical plane between the free forward edge of the base section and the free front edge of the yoke section is unobstructed; and a transparent film that extends around the base section, vertical section, yoke section, and the plurality of generally cylindrical containers and that holds the containers in their relative positions.

6. A package displaying a plurality of different sized containers in an upright orientation along a common front vertical plane, the package comprising:

a sheet material having a horizontal base section, a vertical section made of a single layer of the sheet material, and a yoke section, the sheet material also having a first fold line between the horizontal base section and the vertical section, and a second fold line between the vertical section and the yoke section, the second fold line permitting the yoke section to be disposed in a spaced apart relationship over the horizontal base section;

the horizontal base section having a straight front edge spaced apart from the first fold line, said front edge defining the common front vertical plane wherein the plurality of different sized containers can be placed in an aligned position upright along the front edge with their bottom ends on the base section between the front edge and the first fold line;

the horizontal base section further defining a first upwardly extending tab between the front edge and the first fold line, the tab having a bearing edge for spacing one of the plurality of different sized containers forward away from the first fold line and into the aligned position;

the yoke section having a bearing edge for also spacing said one of the plurality of different sized containers forward away from the first fold line and into the aligned position;

said sheet material being folded to hold the plurality of different sized containers such that the common front vertical plane is unobstructed between the straight front edge of the horizontal base section and the yoke section; and a transparent film that is wrapped around the sheet material and the plurality of different sized containers, the transparent film holding the plurality of different sized containers securely to the sheet material in the aligned position.

7. The package of claim 6, further comprising a second upwardly extending tab in opposed relationship to the first upwardly extending tab, the second upwardly extending tab having a bearing edge for also spacing said one of the plurality of different sized containers forward away from the first fold line and into the aligned position.

8. The package of claim 7 wherein the tabs each have a fold line that is disposed normal to the first fold line.

9. Display packaging holding three containers in an upright orientation along a common front vertical plane, the containers including a first cylindrical container, a second cylindrical container, and a third container having a width smaller than the diameters of each of the first and second cylindrical containers, the display packaging comprising:

a sheet material having a horizontal base section, a vertical section made of a single layer of the sheet material, and a yoke section, the sheet material also having a first fold line between the horizontal base section and the vertical section, and a second fold line between the vertical section and the yoke section, the second fold line permitting the yoke section to be disposed in a spaced apart relationship over the horizontal base section;

the horizontal base section having a straight front edge spaced apart from the first fold line, a first curved portion having a radius to accommodate the first cylindrical container, and a second curved portion having a radius to accommodate the second cylindrical container, said front edge defining the common front vertical plane wherein the three containers can be placed in an aligned position upright along the front edge with the first cylindrical container on the first curved portion, the second cylindrical container on the second curved portion, and the third container arranged between the first and second cylindrical containers on the base section;

the horizontal base section further defining a first upwardly extending tab between the front edge and the first fold line, the tab having a bearing edge for spacing the third container forward away from the first fold line and into the aligned position;

the yoke section having a bearing edge for also spacing the third container forward away from the first fold line and into the aligned position;

said sheet material being folded to hold the plurality of different sized containers such that the common front vertical plane is unobstructed between the straight front edge of the horizontal base section and the yoke section; and a transparent film that is wrapped around the sheet material and the three containers, the transparent film holding the three containers securely to the sheet material in the aligned position.

10. The display packaging of claim 9, wherein the first and second curved portions have different radii to accommodate first and second cylindrical containers having different diameters.

* * * * *